US005194782A

United States Patent [19]

Richardson et al.

[11] Patent Number: 5,194,782

[45] Date of Patent: Mar. 16, 1993

[54] DIMMER FOR FLUORESCENT LAMP

[76] Inventors: Robert H. Richardson, Rt. #1, Box 12A, Hayesville, N.C. 28904; Lee R. Webster, 7 Shoreview Cir., Indialantic, Fla. 32903

[21] Appl. No.: 732,915

[22] Filed: Jul. 19, 1991

[51] Int. Cl.[5] ..... H05B 37/02

[52] U.S. Cl. ..... 315/291; 315/194; 315/DIG. 4

[58] Field of Search ..... 315/291, 194, DIG. 4, 315/290, 290 R, 224, DIG. 5, DIG. 2

[56] References Cited

U.S. PATENT DOCUMENTS

| | | | |
|---|---|---|---|
| 4,287,455 | 9/1981 | Drieu | 315/194 |
| 4,350,935 | 9/1982 | Spira | 315/291 |
| 4,396,869 | 8/1983 | Rosenbaum | 315/194 |
| 4,528,482 | 7/1985 | Merlo | 315/291 |
| 4,634,933 | 1/1987 | Kamon | 315/194 |
| 5,038,081 | 8/1991 | Maiale | 315/291 |

*Primary Examiner*—Eugene R. LaRoche

*Assistant Examiner*—A. Zarabian

*Attorney, Agent, or Firm*—Michael V. Drew

[57] ABSTRACT

The level of brightness of rapid-start fluorescent lighting is modulated over a range from full brightness at 100% lamp power consumption to minimum brightness at near 0% lamp power consumption. Fluorescent lamp brightness is modulated by controlling the amount of time during cycles of voltage application, such as 60 hz, when current flows through the lamp. An input signal voltage in a given range, for example, from 0 to 5 volts dc, is processed to provide an output which controls the duration of current flow. A cut-off circuit prevents any line voltage from being applied to the lamp at chosen values of input voltage. The cut-off circuit contains hysteresis elements which prevents the lamp from fluttering between off and on states. Modules connected to the lamp's heater elements maintain proper heater element voltage to ensure operation of the lamp form 0% to 100% brightness.

11 Claims, 5 Drawing Sheets

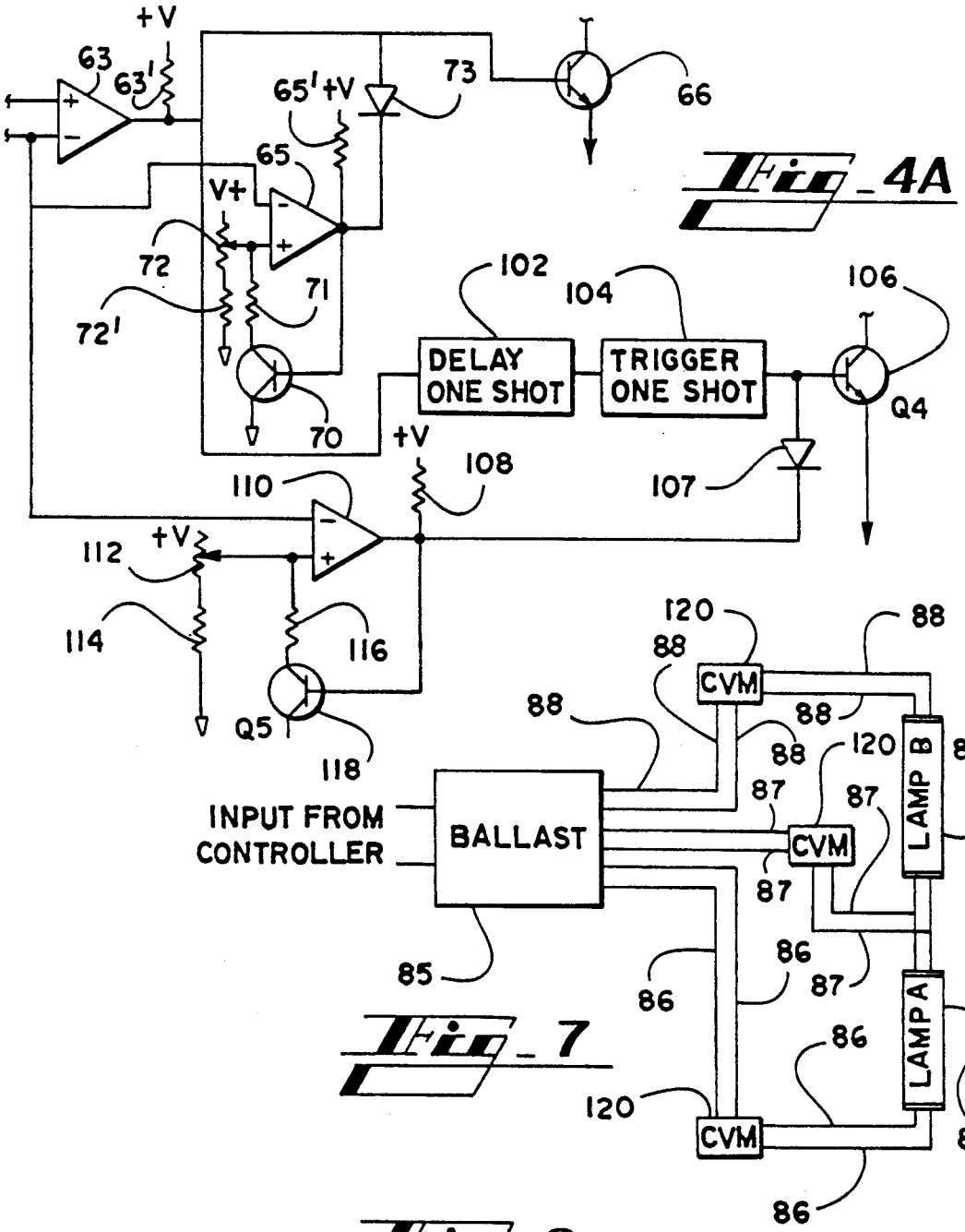
Fig_4A
Fig_7
Fig_8
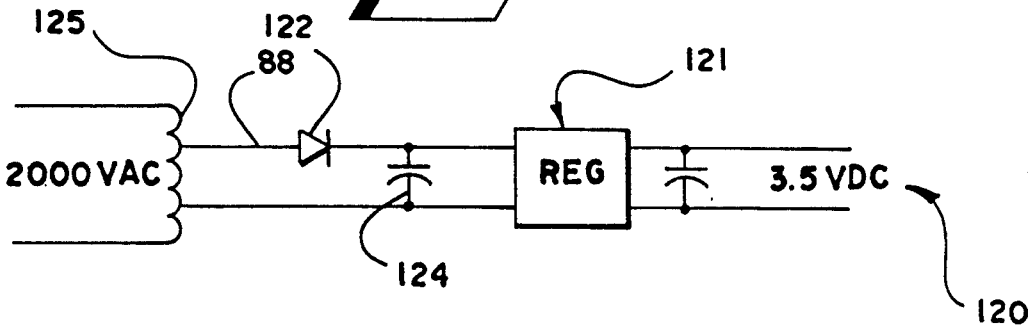

LOCAL DIMMING MODULE

DIMMER FOR FLUORESCENT LAMP

RELATED APPLICATIONS

Certain aspects of this application relate to co-pending U.S. application Ser. No. 07/619,235.

TECHNICAL FIELD OF THE INVENTION

The invention relates to dimmers for fluorescent lamps, and more particularly to a dimmer for rapid-start fluorescent lamps that controls dimming over a range of brightness from 100% to near 0%.

BACKGROUND OF THE INVENTION

In lighting systems, full brightness, or light output, of the lamps used in the lighting system is not always needed or desired. For example, when sunlight is present in the area served by the lighting system, full brightness of the lamps may provide excessive lighting for the area or may exceed optimum lighting levels. It would be advantageous to have natural sunlight and artificial lighting from fluorescent lamps augment each other by dimming the artificial lighting to achieve a desired level of combined light intensity for the area. In other cases, there may be areas that do not require full brightness of lamps continually because there is not a need for the maximum level of light intensity all of the time. In addition, reduction in the light output of lamps generally results in a reduction in electric power consumed for lighting. This is a cost savings for the user.

Full range dimming of fluorescent lamps has been difficult to accomplish because a minimum voltage must be maintained across the lamps to adequately charge gases within the lamp to produce light. Incandescent lamps are generally dimmed by reducing voltage across the lamps. If the voltage across a fluorescent lamp is reduced too greatly there will not be sufficient voltage to operate the lamp. Thus, dimming cannot be accomplished in the same manner as is done with incandescent lighting.

It can be appreciated that it would be advantageous to have a method and apparatus for dimming fluorescent lamps over a full range from 100% brightness to 0% brightness.

SUMMARY OF THE INVENTION

It is an object of the invention to provide full range dimming of fluorescent lamps from 100% brightness to 0% brightness.

The invention controls the brightness of rapid-start fluorescent lighting over a range from full brightness at 100% lamp power consumption to minimum brightness at near 0% lamp power consumption. The invention operates from an input signal voltage in a given range; for example, from 0 to 5 volts dc. The 0–5 volt dc signal is processed by the invention's circuitry to provide an output which when applied to rapid-start fluorescent lighting is proportional to the range of lamp intensity from 0% to 100% brightness. The invention controls fluorescent lamp brightness by controlling the amount of time during cycles of voltage application, such as 60 hz, when current flow through the lamp. The invention also includes circuitry for maintaining voltage across the lamp's heater element to ensure proper operation of the lamp from 0% to 100% brightness.

Other aspects, objects, features, and advantages of the present invention will become apparent to those skilled in the art upon reading the detailed description of preferred embodiments in conjunction with the accompanying drawings and appended claims.

BRIEF DESCRIPTION OF THE DRAWINGS

FIG. 4A is a circuit diagram of additional circuitry for producing proportionally less dimming for additional lighting fixtures which are to be dimmed.

FIG. 7 is a block diagram of the use of an alternate dimming module of a preferred embodiment of the present invention.

FIG. 8 is a circuit diagram of the dimming module of FIG. 7.

DETAILED DESCRIPTION OF A PREFERRED EMBODIMENT

While the specification concludes with claims particularly pointing out and distinctly claiming the subject matter which is regarded as the present invention, the invention will now be described with reference to the following description of an embodiment taken in conjunction with the accompanying drawings.

Figure 1:
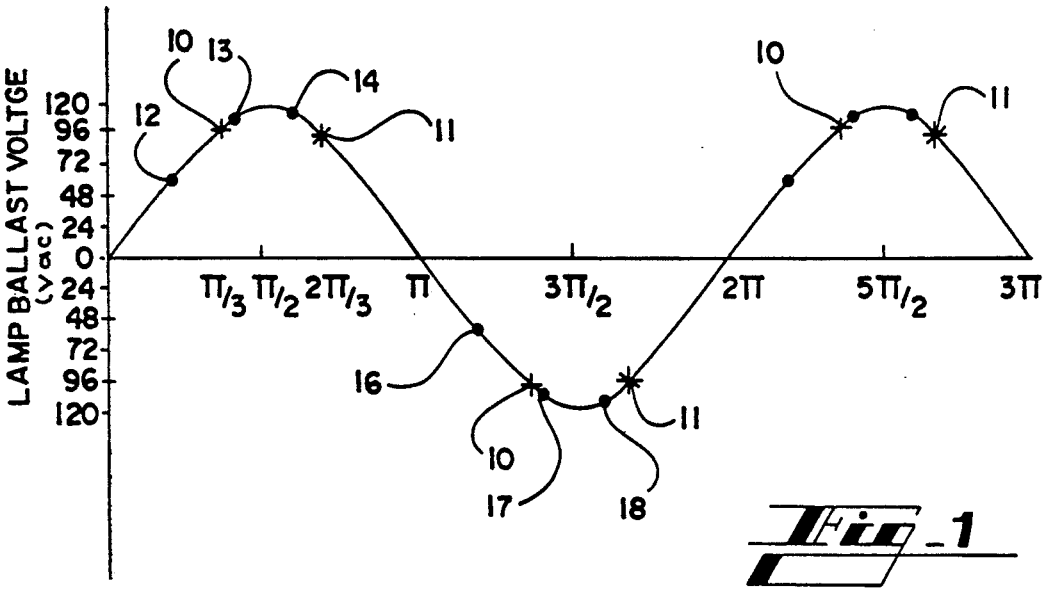
FIG. 1 graphically illustrates voltage across the input electrodes of the ballast of a fluorescent tube employing teachings of the present invention.

FIG. 1 will be referred to first to explain the basic methodology of the invention. FIG. 1 is a graphic representation of the ac voltage applied across the electrodes of the ballast of a fluorescent lamp fixture. This graph employs a sine wave to illustrate the operation of a fluorescent lamp in response to a potential applied across the electrodes of the ballast of the lamp. The horizontal axis denotes the period of the sine wave. The vertical axis contains the amplitude of the wave, which is the ac voltage of the power source. One cycle of voltage application is represented by the period of 0 to 2 pi (360) degrees. In standard ac power sources in the United States one cycle of voltage application occurs sixty (60) times every second, equating to sixty (60) cycles per second. This is more commonly known as 60 hertz line voltage.

Figure 2:
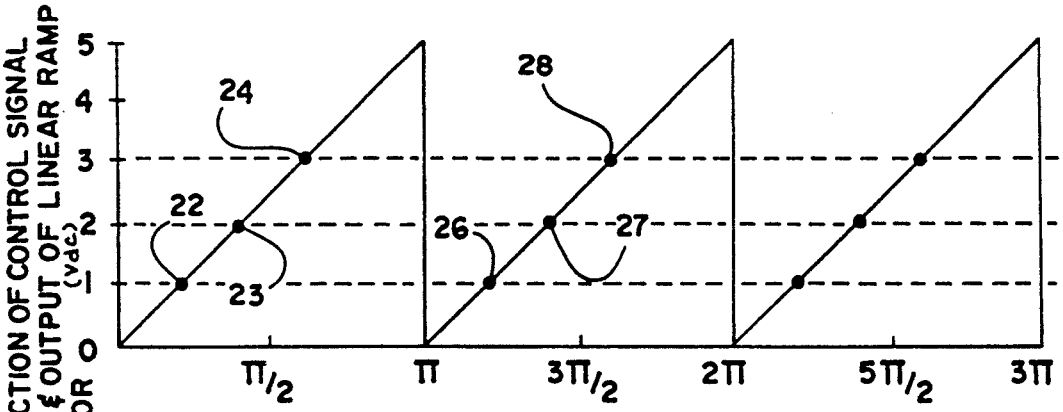
FIG. 2 is a graphical representation of control voltages utilized in the teachings of the present invention.

Rapid-start fluorescent lamps generally consist of an evacuated glass tube filled with argon gas and mercury. The inside of the tube is coated with a fluorescent substance such as phosphor. An electrode is positioned at each end of the tube. When a potential applied across the electrodes reaches a certain level of voltage, the gas in the tube is ionized causing current to flow through the tube. As current flows, the mercury is vaporized and ultraviolet radiation is produced. The ultraviolet radiation falls upon the phosphor coating. The phosphor coating reacts by producing white light which is the illumination utilized for lighting. Once sufficient voltage is reached for ionization to occur (for convenience this point will be referred to as "arc ignition"), the current which begins to flow through the gas will continue to flow until the potential across the electrodes drops below a certain level (for convenience this point will be referred to herein as "arc extinguishment"). In a circuit powered by alternating current, arc ignition voltage will typically be reached when the input across the ballast is about 100 volts. This voltage will be attained as a rising voltage twice during a cycle. This arc ignition voltage is represented by point 10. Arc extinguishment will typically occur when the potential across the electrodes of the ballast drops below the ignition voltage. This arc extinguishment voltage is illustrated as point 11. Arc ignition and extinguishment will occur two (2) times per cycle, and thus 120 times every second under 60 hz power. Brightness, or intensity, of the lamp is determined by how long current flows through the lamp causing the phosphor to glow before it is extinguished. The longer current flows, the greater is the area under the curve between points 10 and 11, and the brighter the lamp glows. The lesser the duration of current flow, the smaller is the area under the curve, and the less brightly the lamp glows. The invention dims fluorescent lamps by controlling when arc ignition voltage is applied across the electrodes of the lamp. The portion of the curve in FIG. 1 between point 10 and point 11 represents 100% brightness. This is the maximum period of time during each half-cycle in which the lamp will be lit. During normal operation, that is, before application of the invention's control circuit, the lamp ballast is connected to a voltage source which starts at 0 for each cycle, increases through point 10 to a maximum voltage, proceeds to 0 again as it crosses the horizontal axis, passes through point 10 below the horizontal axis, passes through a maximum voltage amplitude again and completes a cycle at the horizontal axis. The invention attains dimming by delaying when arc ignition occurs. This delay reduces the amount of time during which current will flow through a half-cycle, and, as previously described, causes the lamp to glow less brightly. A preferred embodiment of the invention delays arc ignition by not allowing the potential represented by the curve in FIG. 1 to be applied across the electrodes of the ballast of the lamp until a point on the curve, such as 13 or 14, is reached. When the voltage represented by points 13 or 14 is applied across the lamp, the lamp will still become extinguished when the voltage drops below point 11. Thus, the period in the half-cycle during which current flows through the lamp is represented by the curve between points 13 and 11 or between the points 14 and 11. When this delayed arc ignition is achieved for each half cycle, the period of ignition is reduced and concomitantly the lamp does not glow as brightly because of the lesser period of ionization and current flow. The closer the point of arc ignition is to the point of extinguishment 11, the less brightly the lamp glows. The arc ignition voltages represented by points 12, 13, 14, 16, 17 and 18 are determined by the control system of the preferred embodiment of the invention. These points are directly related to the points of intersection of a sawtooth wave created by a linear ramp generator and the control voltage supplied by early stages of the control circuit. Referring now also to FIG. 2, horizontal lines representing levels of input voltage are shown superimposed over a sawtooth wave representative of the output of a ramp generator. The points of intersection 22, 23, 24, 26, 27, and 28 in FIG. 2 correspond respectively to points 12, 13, 14, 16, 17 and 18 of FIG. 1, and are indicative of arc ignition based upon the input voltage. As can be seen, lower input voltage (resulting from low sunlight and low current from the sensor) causes earlier arc ignition and, thus, longer ignition and greater lamp intensity, as has been previously explained. Higher input voltage (resulting from significant sunlight and high current from the sensor) causes later arc ignition and lesser lamp intensity, as has been previously explained.

Figure 3:
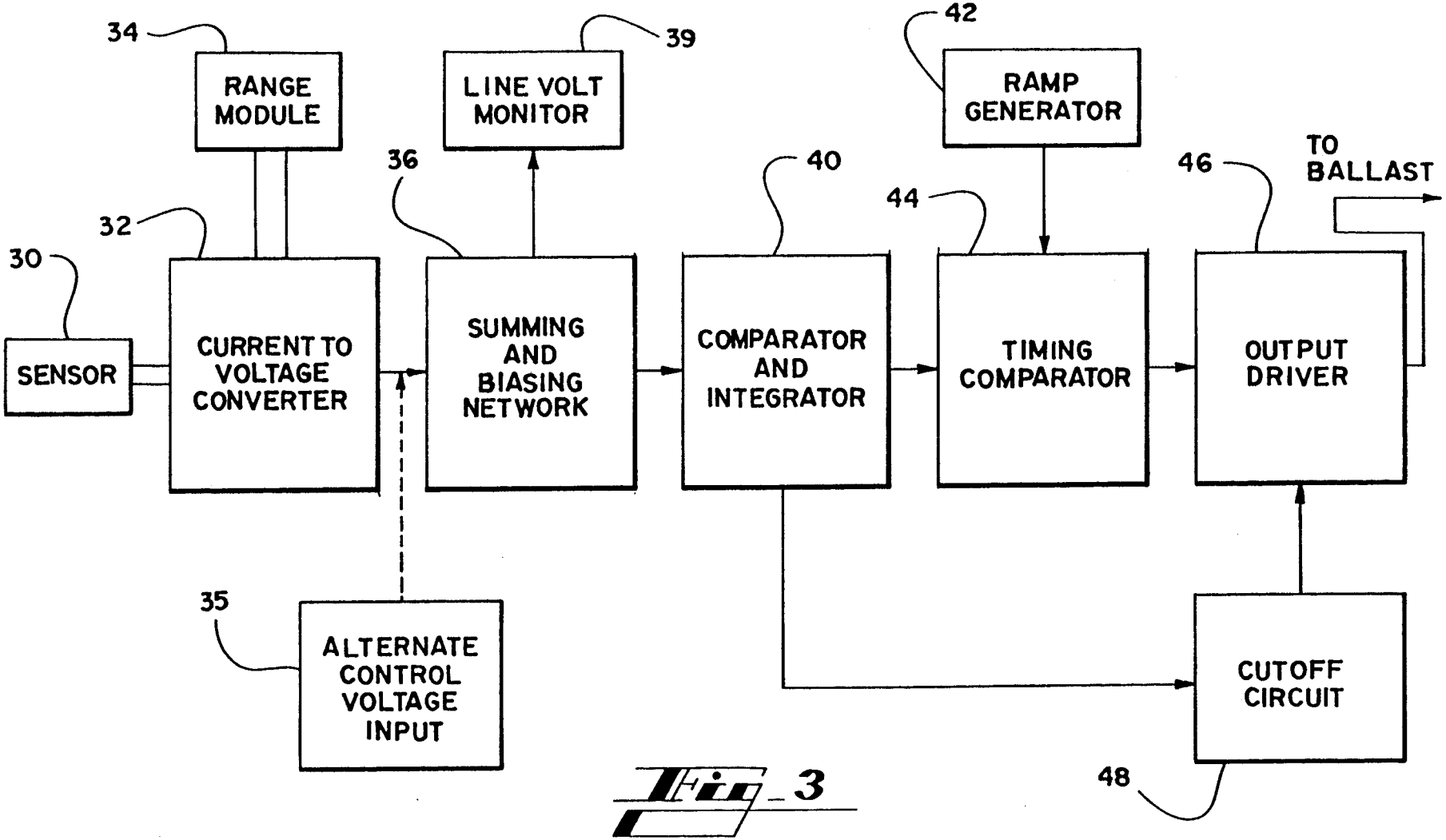
FIG. 3 is block diagram of a controller circuit of a preferred embodiment of the present invention.

Reference will now be made to FIG. 3 to describe the components of the preferred embodiment of the invention. After a general discussion of the circuit components of the preferred embodiment based upon the block diagram of FIG. 3, a more detailed description of the components will be discussed, based upon the circuit schematic diagram of FIG. 4. In FIG. 3, a Sensor 30 receives sunlight as its input. Its linear output is a current proportional to the intensity of sunlight received. The current generated by the Sensor 30 is converted to a measurable voltage by a Current to Voltage Converter 32. The Current to Voltage Converter 32 is an operational amplifier. A Range Module 34 is connected to the operational amplifier causing the operational amplifier to give an output voltage that is within a given range and representative of a given input light range. The range chosen for this embodiment is 0 to 5 vdc. The voltage range is in direct proportion to intensity of sunlight because it is directly proportional to the current from the Sensor 30 which, in turn, is in direct proportion to the intensity of sunlight.

The input which is processed by and governs the controller system is a voltage in the range of 0 to 5 volts d.c. This input may be provided by the Sensor 30 and Current to Voltage Converter 32, or it may be fed into the circuitry of the invention from an energy management control system or any device such as a potentiometer that directly applies 0 to 5 volts d.c. to the invention's control circuitry. In FIG. 3, this alternate control signal is referred to as Alternate Control Voltage Input 35.

The 0-to-5-volt d.c. signal either from the Sensor 30-Converter 32 elements or from an Alternate Control Input 35 is received by the Summing Network 36. The Summing and Biasing Network 36 enables the invention to compensate for changes in voltage delivered by the power supply and readies the signal for the next stage of processing and supplies biasing for the control circuit. The reason for compensation is to prevent variations in power line voltage from causing changes in lamp illumination that would be perceived and annoying to individuals. For example, if the power supply normally provides 117 RMS volts ac, a period of 130 RMS volts power application or 105 RMS volts power application would cause lamps connected to the system to glow respectively brighter or dimmer. Such a variation in power line voltage would undermine the brightness-controlling effect of the invention if not compensated for. The Summing and Biasing Network 36 sums the 0-to-5 vdc input signal with a line voltage reference signal to produce a drive signal that is processed at the next stage of the invention.

The Line Voltage Monitor 39 samples and rectifies the ac input to give a dc voltage output that is representative of the ac input level. This dc voltage is summed into the control signal in the Summing and Biasing Network 36.

The output of the Summing and Biasing Network 36 is the input for the Comparator and Integrator 40. The Comparator and Integrator 40 dampens any rapid changes in the input control voltage so that the control circuit produces a smooth response to input. The signal is then passed on to a Timing Comparator 44 and a Cut-off Circuit 48. The Timing Comparator 44 compares the control voltage with a voltage from the Ramp Generator 42 to produce an output signal which controls an output Driver 46. When the voltage of the Ramp Generator 42 exceeds the control voltage the Timing Comparator 44 causes the Output Driver 46 to be turned on. The Output Driver 46 then controls the point in an ac cycle during which line voltage will be applied to the ballast of a lamp. The Cut-off Circuit 48 causes the Output Driver 46 to cut off when the output of the Timing Comparator 44 rises above a first predetermined level. Once the Output Driver 46 (and lamp) is off, the Cut-off Circuit 48 will not allow it to be turned on again until the control signal drops below a second predetermined level. The first predetermined level corresponds to bright sunlight or any other condition wherein light from the fluorescent lamps is to be eliminated. The second predetermined level is slightly less than the first predetermined level. This prevents the system from fluttering back and forth between off and on positions.

Figure 4:
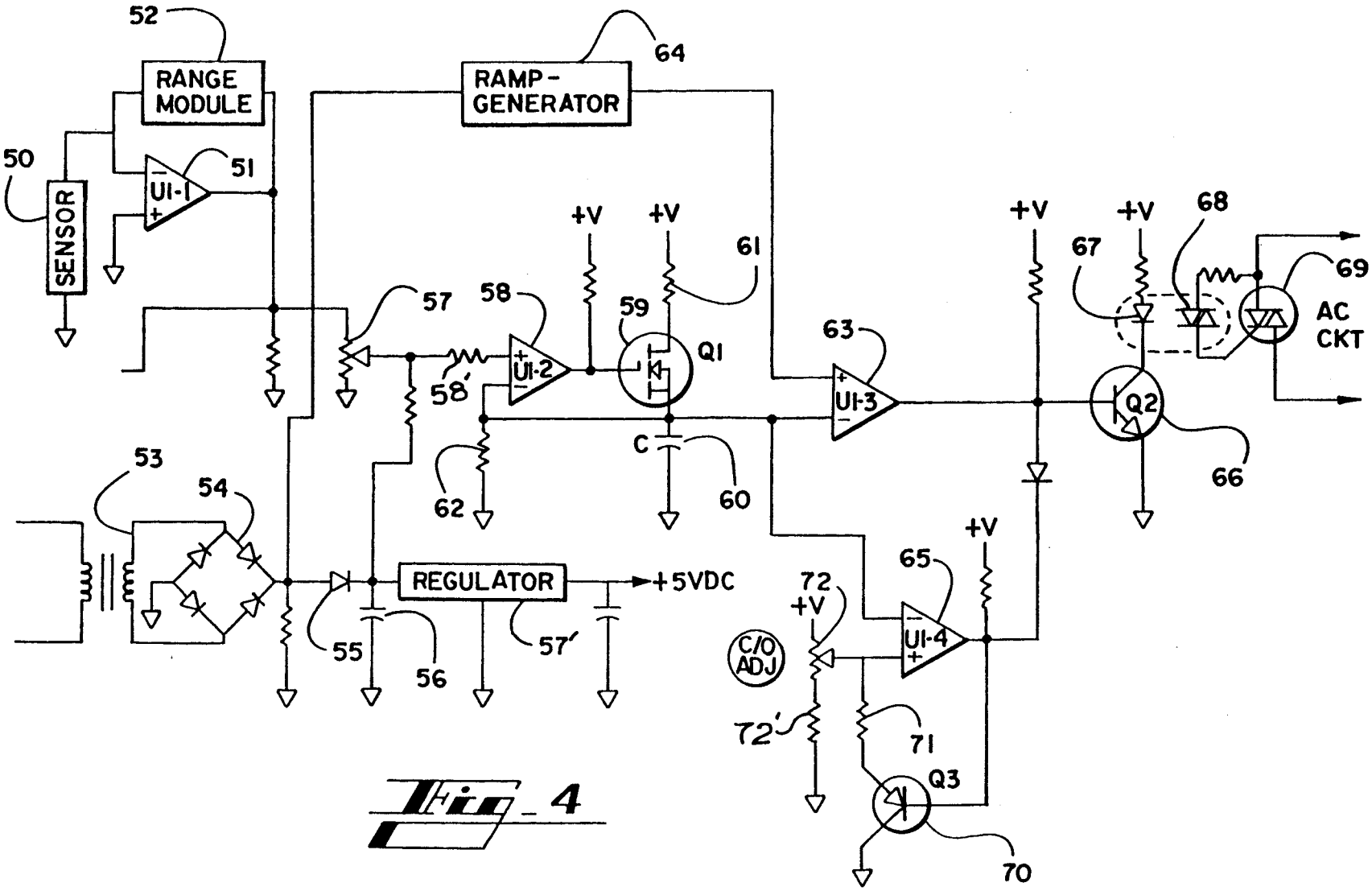
FIG. 4 is a detailed circuit diagram of the circuit of FIG. 3.

Reference is now made particularly to the schematic circuit diagram at FIG. 4 to more particularly describe the components of the preferred embodiment from the block diagram of FIG. 3.

Sensor 50 is a photo cell utilized in a short-circuit mode to produce a short-circuit current that is linear with light intensity. A luminosity compensating filter is interposed between the photodiode and sunlight to filter out light frequencies to which the human eye would not be responsive. This creates a spectral response for the Sensor 50 close to that exhibited by the human eye. This methodology is also described in co-pending U.S. patent application Ser. No. 07/619,235. The sensitivity of the filtered photo cell closely matches the CIE photopic curve. The CIE photopic curve is a graphic representation of the response of the human eye to the spectrum of visible light. The short-circuit generated by the photo cell is nearly insensitive to temperature variations and is linear over input sunlight levels of 0.1 lux to greater than 10,000 lux.

The current to voltage converter 32 is an operational amplifier 51 wherein the noninverting input is connected to ground and the inverting input is connected to the short-circuit current output of the Sensor 50 and the feedback from the output of the operational amplifier 51. The output of the operational amplifier is a voltage. As stated above, the Range Module 52 is placed in the feedback path to set the output voltage in a range from 0 to 5 vdc in proportion to the light intensity received by the sensor. The Range Module may be a standard plug-in-type such as Model Number ICS-A manufactured by T&M, Inc.

As previously mentioned, the Summing and Biasing Network utilizes power from the power source for the lighting system which is to be controlled. The voltage source which is used in the preferred embodiment is a stepped-down voltage from the power line voltage rather than a direct use of power line voltage. Transformer 53 provides the stepped down voltage. A rectifying bridge 54 converts the alternating current to direct current. The dc voltage is smoothed out and filtered by diode 55 and capacitor 56. A potentiometer 57 mixes the filtered voltage sampled from the power line with the control voltage. The regulator 57' provides regulated 5 vdc power for the control circuitry.

The signal from the Summing and Biasing Network 36 of FIG. 3 passes to the Comparator and Integrator 40 of FIG. 3 which dampens changes in the control voltage to build hysteresis into the control system. The Comparator and Integrator 40 serves the single damping purpose described above but consists of several essential elements which are shown in FIG. 4, namely, an operational amplifier (op amp) 58 used as a precision voltage comparator, a metal-oxide-semiconductor field-effect-transistor (MOSFET) 59, a capacitor 60 and resistors 61 and 62. An isolation resistor 58' placed before the op amp 58 provides isolation for the op amp 58. Control input voltage is applied to the noninverting terminal of the op amp 58. The inverting terminal of the op amp 58 provides the reference voltage. The output of the op amp 58 is applied to the gate of the N-channel, enhanced mode MOSFET 59. The voltage applied to the gate of the MOSFET 59 creates a channel which causes current to flow from the device's drain through the source. When this circuit is closed, the capacitor 60 is charged through the resistor 61. Once charged, the capacitor 60 discharges through the resistor 62 to which it is connected in parallel. The resistors 61 and 62 in the preferred embodiment are about 10 megohms each. These resistors 61 and 62 decrease the charging and discharging rates, respectively, for the capacitor 60. The charge upon the capacitor 60 establishes the reference voltage for the inverting terminal of the op amp 58. The magnitude of any change in the control voltage which is applied at the noninverting terminal of the op amp 58 does not reach the part of the control system beyond the Comparator and Integrator 40 as quickly as that change occurs because of the damping, or delay, provided by the composite elements of the Comparator and Integrator 40.

The damped signal passes from the Comparator and Integrator 40 to a Timing Comparator 44 and a Cut-off Circuit 48. The Timing Comparator 44 uses the control signal as a reference signal for the inverting terminal of an op amp 63. An ultra linear sawtooth wave from a ramp generator 64 is applied at the noninverting terminal of the op amp 63. The ramp generator 64 is triggered by the rectified but unregulated voltage taken from the rectifying bridge 54. Referring now also briefly to the graphs of FIG. 2 and FIG. 1, each ramp of the sawtooth wave corresponds to one half-cycle of ac line voltage. The points of intersection of the input control voltage and ramp voltage indicated by 22, 23 and 24 correspond to the portion of the sine wave above the x-axis of FIG. 1, while points 26, 27 and 28 correspond to the portion of the sine wave below the x-axis of FIG. 1. These are points of arc ignition and are determined by the op amp's 63 comparison of the voltage at the noninverting terminal to the voltage at the inverting terminal. The output of op amp 63 will be switched to high when the sawtooth wave rises above the point of intersection 22, 23, 24, 26, 27 or 28. This output is applied to and energizes the base of an NPN bipolar transistor 66 (the Output Driver 46 of FIG. 3) which is acting as a switch. Voltage applied to the base of the transistor 66 closes the switch and causes current to flow through a light-emitting diode (LED) 67. The LED 67 is a part of an optical coupler. A phototriac 68 is the receiving component of the optical coupler. When the phototriac 68 is energized, it in turn triggers a triac 69 which imparts ac voltage to a lamp ballast. An example of a suitable phototriac 68 is MOC 3010 manufactured by Motorola electronic parts manufacturer. The triac 69 imparts ac line voltage to the ballast at a moment in time corresponding to a point on the curve of FIG. 1 such as 12, 13, 14, 16, 17 or 18. Once the triac 69 is turned on it remains on until the ac voltage passes through 0 volts. As the ac voltage continues its sinusoidal path as illustrated in FIG. 1, the transistor 66 switch is again closed during the next sawtooth wave generated, at the appropriate intersecting point. Thus, during each half-cycle of ac voltage, arc ignition is accomplished and current flows through a lamp until arc extinguishment, and voltage is applied to the electrodes of the ballast until the line voltage drops to 0 vac. It is possible to energize more than one triac at a time and therefore control more than one light circuit at a time.

The Cut-off Circuit 48 consists of an op amp 65 used as a comparator, a PNP bipolar transistor 70, a resistor 71 and a potentiometer 72. An additional resistor 72' may be used to connect the potentiometer 72 to ground. This portion of circuitry prevents potential from being applied to the transistor switch 66 when there is very bright sunlight or in other instances when less light from the fluorescent lighting is desired. That is, when sunlight or other conditions result in an input control voltage level above a threshold of, for example, about 3.0 volts dc. The environment served would be lit solely by sunlight or other illumination sources above the threshold level. The input control voltage coming from the Comparator and Integrator 40 is the reference voltage which is fed to the inverting terminal of the op amp 65. The potentiometer 72 taps potential from the 5 vdc potential provided by the power supply which powers the entire circuit of the invention. The level of tapped potential becomes the threshold at which the circuit no longer permits the transistor 66 to be switched on. Using the example of 3 vdc as a level indicative of bright sunlight and a cut-off level, the wiper of the potentiometer 72 is set to apply 3 vdc at the noninverting terminal of the op amp 65. The voltage at the inverting terminal is the circuit input voltage which varies. When it is below 3.0 vdc, the output of the Cut-off Circuit op amp 65 is high and the transistor switch 70 is turned off, opening the switch. The resulting current flow maintains the transistor 70 switch in an open position. When input control voltage to the inverting terminal is above 3.0 vdc, the output of the op amp 65 switches to low. This places the transistor 70 switch in its closed position where it remains until the op amp 65 changes state again. Thus, when the op amp 65 output switches to low, a short circuit to ground through the op amp 65 and transistor 70 is created. This, in turn, causes current from the output of the timing comparator op amp 63 to be diverted away from the output driver transistor 66 through the short circuit to ground. When the cut-off circuit transistor 70 conducts, the reference voltage at the non-inverting terminal of the cut-off-circuit op amp 65 is reduced by an amount determined by the magnitude of resistance of the resistor 71 connected thereto. This provides a fixed and predetermined hysteresis. The control signal must now drop below the new (and now less than 3.0 vdc) voltage before the op amp 65 switches to high and releases control of the driver transistor 66 and thus allows the fluorescent lamps to turn back on. The elements of the circuit which precede the cut-off circuit continue to operate during the "cut-off" period. When the lamp comes back on after being shut off, it is at a dimmed level set by the control signal voltage. The cut-off circuit does not flip-flop back and forth around the cut-off threshold because of the hysteresis action described above.

As can be seen by reference to FIG. 1 and FIG. 2, bright sunlight, which results in a high input control voltage, would cause arc ignition to occur later than point 14 or 18, creating current flow of a short duration and low lamp intensity. Arc ignition past or equal to point 11, the point of arc extinguishment, would result in no arc ignition at all. The cut-off circuit previously described may be used to shut off the controller system prior to the concurrence of arc ignition and arc extinguishment at point 11. Points 12 and 16 represent very early application of arc voltage to the lamp and, in turn, result in the brightest lamp intensity possible because the full range of lamp voltage from earliest arc ignition at point 10 to extinguishment at 11 would occur. It has been found that the control circuit of the preferred embodiment produces and favorably reacts to an input control voltage of from about 2.5 vdc, representing the lowest level of sunlight, to about 3.5 vdc, representing the highest level of sunlight.

More than one lighting circuit may be dimmed from a single initial input by providing a separate triggering circuit consisting of an additional transistor switch, optical coupler and triac for each circuit to be controlled. Referring briefly to FIG. 4A, therein is illustrated additional circuitry which works in conjunction with the circuitry discussed above to dim a separate lighting circuit. A reason for a separate triggering circuit would be to provide more than one level of dimming from a single input signal. For example, if an area is lighted by two rows of fluorescent lamp fixtures and each row may be controlled separately, if one row is adjacent windows while the other row is adjacent a wall and away from the windows, the row adjacent the windows would require less light transmission than the row adjacent the wall and away from the windows. The row of lights adjacent the windows may be made to provide less light than the row of lights adjacent the wall by delaying arc ignition for the row of lights adjacent the windows. Referring now to FIG. 4A, the delay may be achieved by providing a separate triggering circuit which has a delay one-shot 102 and a trigger one-shot 104 inserted between the output of op amp 63 and the gate of a transistor switch 106 which is the driver for the separate lighting circuit. The delay one-shot 102 and the trigger one-shot 104 cause the driver 106 to energize its optical coupler after the un-delayed signal energizes a different switch, such as the transistor 66 described above and also illustrated in FIG. 4A. The lights on the delayed circuit are energized for a lesser period of time and thus glow dimmer than the lights on a circuit not affected by delay. An example of a suitable one-shot device is the NE 555 chip. The delay circuit also has its own cut-off circuitry consisting of the cut-off circuitry elements which have been described previously, namely, a diode 107, an op amp 110, a potentiometer 112, a resistor 114 to ground for the potentiometer 112, a PNP bipolar transistor 118 and a resistor 116. Successive delay circuits may be used to provide different levels of dimming corresponding to different amounts of delay.

Rapid-start fluorescent lamps contain a heater element that maintains the gas and mercury in the tube at an optimum temperature for ionization and vaporization. The heater element maintains the proper temperature by having a certain voltage continuously present across it during lamp use. An aspect of this invention maintains sufficient heater voltage no matter what voltage is applied across the lamp electrodes. Even if the voltage across the electrodes drops below requisite heater voltage.

Figure 5:
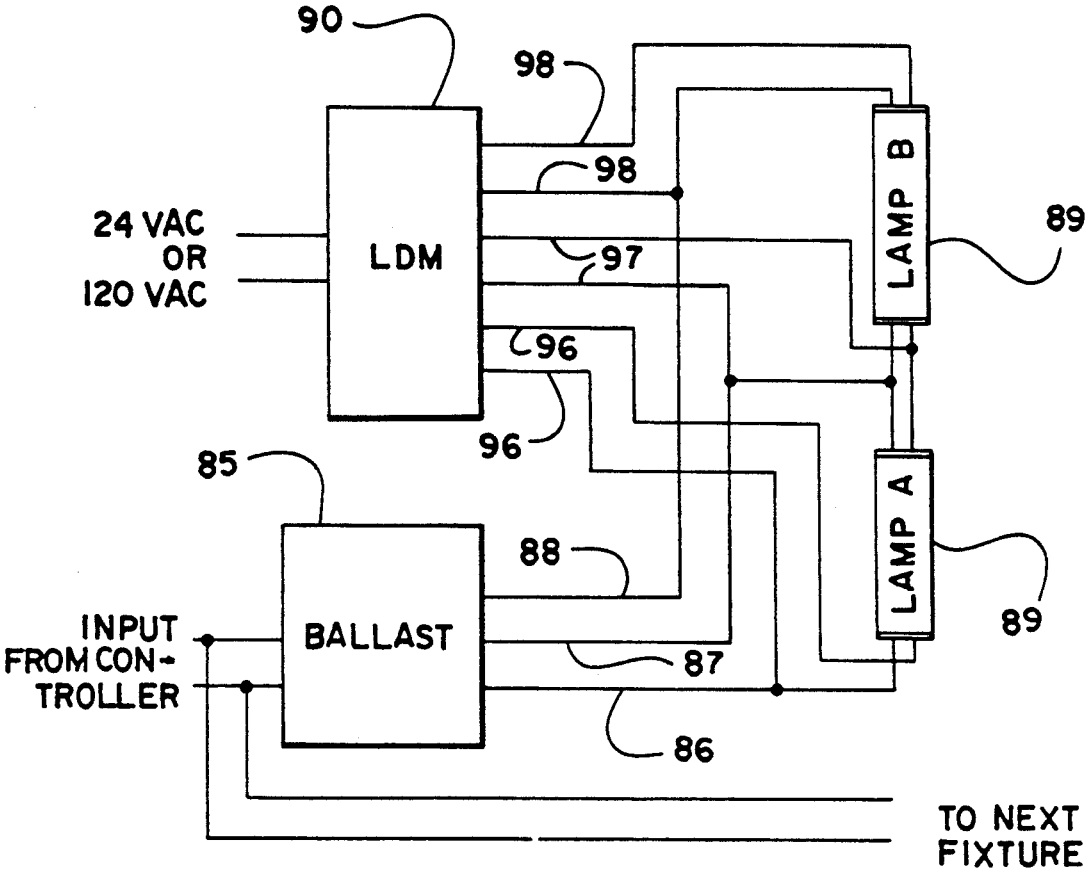
FIG. 5 is a block diagram of the use of a dimming module of a preferred embodiment of the present invention.

The preferred embodiment of the invention utilizes what will be referred to herein as a Local Dimming Module (LDM) to maintain proper voltage for the heater of a lamp. Referring now to FIG. 5, the connection of the LDM 90 in a lamp circuit is illustrated. A typical two-lamp fluorescent fixture consists of a ballast 85 and two lamps 89. The line voltage is supplied to the ballast 85 through connecting wires from the controller circuit. Blue leads 86 connect one end of lamp A to the ballast 85, yellow leads 87 connect the other end of lamp A and one end of lamp B to the ballast 85, and red leads 88 connect the other end of lamp B to the ballast 85. The electrical energy supplied through the ballast 85 provides arc ignition and maintains heater voltage. Typically, there is a filament at each end of a lamp. There are normally two blue leads, two yellow leads and two red leads connected as described above. Each pair of each color leads is connected to a heater filament of the two lamps 89 in a two-lamp set. In a preferred embodiment of the invention, a potential sufficient to maintain minimum heater filament voltage is applied across each pair of leads. The LDM 90 has pairs of leads 96, 97 and 98 that correspond to pairs of leads from the ballast 85 to a lamp 89. Each pair of leads 96, 97 and 98 from the LDM 90 has a potential of approximately 4.0 vac across the leads. This potential is sufficient to maintain the heater filament of a lamp 89 at the proper temperature. The heater voltage may be either ac or dc. In the preferred embodiment of the invention as illustrated, ac voltage is used because it is easier to supply to the circuit when standard ac power is used. As shown in FIG. 5, the LDM 90 is installed by removing one of each color lead from the lamp circuit and connecting it to one of the same color leads from the LDM 90. Each of the remaining three unattached LDM 90 leads is attached to the ballast 85 lead of the same color, which is still attached to a lamp 89. This completes the circuit that is necessary to apply voltage across the filament in each end of a lamp 89, while also leaving each lamp 89 connected in parallel to power line voltage supplied via the controller circuitry. Although it is not necessary for each pair of leads from the LDM 90 to match the color of a pair of leads from the ballast 85, it makes connection of the LDM 90 easier.

Figure 6:
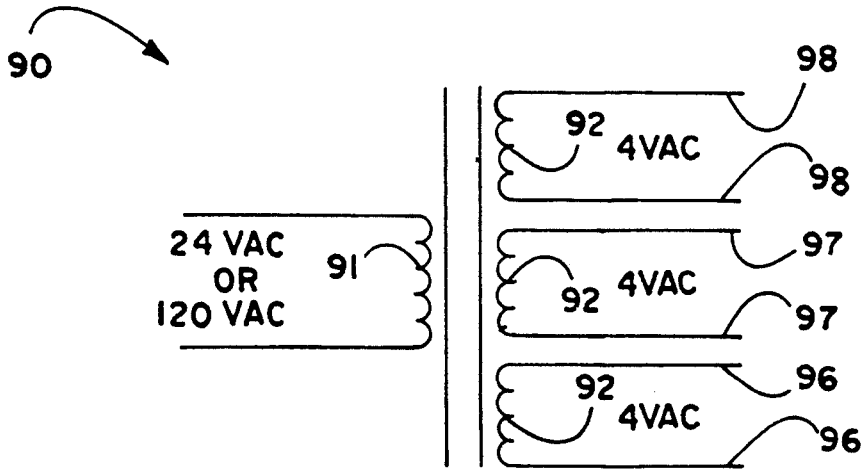
FIG. 6 is a circuit diagram of the dimming module of FIG. 5.

Referring now to FIG. 6, therein is illustrated the LDM 90 of FIG. 5. It is essentially a transformer having a 120- or 24-volt ac potential applied across a primary winding, and three secondary windings. Each secondary winding delivers a 4-volt ac potential. This ac potential can be rectified, filtered and regulated to yield approximately 3 vdc potential.

Proper filament voltage may also be maintained by a slightly different circuit arrangement. Referring now to FIG. 7, for convenience, this alternate arrangement will be referred to as the Constant Voltage Module (CVM) 120. In this arrangement, the CVM's 120 are inserted into the path of the wires 86, 87 and 88 which connect a ballast 85 to its lamps 89. Referring now to FIG. 8, a typical CVM 120 is illustrated. In general, in a ballast 85, voltage from a high-voltage winding 125 is tapped to provide the voltage for a lamp 89 filament. The voltage of the high-voltage winding 125 is used to provide the high voltage necessary for arcing in a lamp 89. For example, a voltage of about 2,000 vac may be utilized. From this winding at 2,000 vac potential, the unaltered light fixture taps about 4 vac and directs it to the heater filament of a lamp 89. The CVM 120 is essentially a voltage regulator that maintains voltage across the filament at an optimum level; for example, at about 3.5 v. The CVM 120 shown is a diode 122 and a capacitor 124 that converts the ac voltage to dc voltage and a regulator 121 maintains a potential of about 3.5 vdc across the output leads 88 which go to a lamp 89. The input leads for the CVM 120 are the leads from the high-voltage winding of the ballast 85 to a lamp 89. The CVM 120 is installed by connecting the device across a pair of leads, such as the red leads 88 which are illustrated. As shown in FIG. 7, a CVM 120 is installed across each pair of leads 86, 87 and 88. When used in conjunction with the dimming circuit described above, the CVM 120 derives its voltage from the ballast 85 which in turn is being supplied voltage from the dimming circuit described above. This voltage may be decreased below a level which is necessary to allow the CVM to charge sufficiently to maintain proper voltage for the heater filament. Thus, the CVM 120 is able to perform its function down to a certain level of dimming, namely, about 10% of maximum light intensity (or 90% dimming), rather than a level just at 0% (or 100% dimming).

The addition of these LDM's 90 to each fixture in a lighting circuit allows each fixture in the circuit to be independently controlled including allowing each to be independently turned on and off. This is especially important in an office environment where several offices are generally on the same lighting circuit but have independent on/off wall switches in distinct offices.

The system described allows the lighting in an office to be dimmed to near zero illumination and turned on and off without interfering with or receiving interference from the light settings for a different office. The lamps in an office will also be turned on at the level set by the circuitry of the invention without interfering with or receiving interference from the light settings for a different office.

Although the invention has been described with reference to 120 vac line voltage, the principles of operation are applicable to a 277 vac system.

As should be apparent from the foregoing specification, the invention is susceptible of being modified with various alterations and modifications which may differ from those which have been described in the preceding specification and description. Accordingly, the following claims are intended to cover all alterations and modifications which do not depart from the spirit and scope of the invention.

What is claimed is:

1. A method for dimming a fluorescent lamp powered by ac line voltage comprising:

providing an input dc voltage signal which is linearly proportionate to a level of dimming to be achieved;

comparing said input dc voltage signal with a sawtooth wave representing voltage pulses generated by a linear ramp generator wherein teeth of said sawtooth wave correspond to half-cycles of the ac line voltage, and detecting each time that a voltage on a ramp of a said sawtooth wave becomes equal to said input dc voltage signal; and turning on the ac line voltage to the fluorescent lamp each time said equality between said voltage on a ramp of a said sawtooth wave and said input dc voltage signal is detected and, each time thereafter, turning off the ac line voltage to the fluorescent lamp when the ac voltage passes through a zero point of a sinusoidal wave representative of the ac line voltage.

2. A circuit for dimming a fluorescent lamp powered by ac line voltage comprising:

means for receiving an input dc voltage signal in a range linearly related to the level of dimming to be achieved;

means for comparing said input dc voltage signal with a sawtooth wave representing voltage pulses generated by a linear ramp generator wherein teeth of said sawtooth wave correspond to half-cycles of the ac line voltage, and producing a driving dc voltage signal each time that a voltage on a ramp of a said sawtooth wave and said input dc voltage signal are equal, connected to said means for receiving an input dc voltage signal; and means for turning on the ac line voltage to the fluorescent lamp each time that a said driving dc voltage signal is produced and, each time thereafter, turning off the ac line voltage to the fluorescent lamp when the ac voltage passes through a zero point of a sinusoidal wave representative of the ac line voltage, connected to said means for comparing and producing and connected to the ac line voltage.

3. The invention of claim 2, further comprising means for damping changes in said input dc voltage signal, interposed between said means for receiving an input dc voltage signal and said means for comparing and producing.

4. A circuit for dimming a fluorescent lamp powered by ac line voltage comprising:

means for receiving an input dc voltage signal in the range from 0 to 5 vdc which said input dc voltage signal is linearly related to the level of dimming to be achieved;

means for combining said input dc voltage signal with a dc voltage reference signal sampled from the ac line voltage, to compensate for ac line voltage fluctuations, for biasing the circuit at +5 vdc, and for transmitting said input dc voltage signal which has been summed, connected to said means for receiving an input dc voltage signal;

a first operational amplifier having an inverting terminal, a noninverting terminal and an output terminal;

means for connecting said noninverting output of said first operational amplifier and said means for combining, biasing and transmitting;

a metal-oxide-semiconductor field-effect-transistor having a gate, a drain and a source;

means for connecting said gate of said metal-oxide-semiconductor field-effect-transistor and said output of said operational amplifier;

a first resistor having a resistance of about 10 megohms;

means connecting said first resistor between a point of positive circuit bias and said drain of said metal-oxide-semiconductor field-effect-transistor;

a polarized capacitor having a positive terminal and a negative terminal and having a capacitance of about 22 microFarads;

means for connecting said positive terminal of said polarized capacitor to said inverting terminal of said first operational amplifier;

means for connecting said negative terminal of said polarized capacitor to a point of negative circuit bias;

a second resistor having a resistance of about 10 megohms;

means for connecting said second resistor between said inverting terminal of said first operational amplifier and a point of negative circuit bias;

a second operational amplifier having a noninverting terminal, an inverting terminal and an output terminal;

means for connecting said positive terminal of said polarized capacitor and said inverting terminal of said second operational amplifier;

means for connecting said noninverting terminal of said second operational amplifier and an output of a linear ramp generator which generates a linear ramp per one-half cycle of ac line voltage;

an NPN bipolar transistor having a gate, a collector and an emitter;

means for connecting said gate of said NPN bipolar transistor and said output of said second operational amplifier;

means for connecting said emitter of said NPN bipolar transistor to a point of ground circuit bias;

an optical coupler having a light-emitting diode and phototriac;

means for connecting a cathode of said light-emitting diode and said collector of said NPN bipolar transistor;

a third resistor;

means for connecting said third resistor between a point of positive circuit bias and an anode of said light-emitting diode;

a triac;

means for connecting said phototriac and said triac; and means for connecting said triac to a ballast of a fluorescent lamp and the ac line voltage;

said resistors, operational amplifiers, transistors, light-emitting diode and capacitor having parameters selected so that said input dc voltage signal causes said triac to energize and apply voltage across terminals of the ballast of the fluorescent lamp for a duration of time during a half-cycle of ac voltage application, and wherein said duration of time during a half-cycle of ac voltage application decreases proportionally with an increase in voltage of said input dc voltage signal.

5. The invention of claim 4, further comprising:

a third operational amplifier having an inverting terminal, a noninverting terminal and an output terminal;

means for connecting said positive terminal of said polarized capacitor and said inverting terminal of said third operational amplifier;

a PNP bipolar transistor having a gate, a collector and an emitter;

means for connecting said output terminal of said third operational amplifier and said gate of said PNP bipolar transistor;

means for connecting said collector of said PNP bipolar transistor and a point of ground circuit bias;

a fourth resistor;

means for connecting said fourth resistor between said noninverting terminal of said third operational amplifier and said emitter of said PNP bipolar transistor;

a potentiometer having a wiper and two terminals;

means for connecting a terminal of said two terminals of said potentiometer to a point of positive circuit bias;

means for connecting said wiper of said potentiometer and said noninverting terminal of said third operational amplifier;

means for connecting an other terminal of said two terminals of said potentiometer and a point of ground circuit bias;

a diode;

means for connecting an anode of said diode and said output terminal of said second operational amplifier; and means for connecting a cathode of said diode and said output terminal of said third operational amplifier;

said third operational amplifier, said PNP bipolar transistor, said fourth resistor, and said diode having parameters selected so that said NPN bipolar transistor is not energized and said PNP bipolar transistor is energized when a voltage applied to said inverting terminal of said second operational amplifier is greater than a voltage selected by adjustment of said potentiometer and said NPN bipolar transistor does not conduct again until the voltage applied to said inverting terminal of said third operational amplifier decreases to slightly below said voltage selected by adjustment of said potentiometer.

6. The invention of claim 4, further comprising:

at least one delay one-shot connected in series to a trigger one-shot;

additional NPN bipolar transistor corresponding to an each said one delay one-shot, having a gate, a collector and an emitter;

means for connecting said output terminal of said second operational amplifier to said at least one delay one-shot;

means for connecting said gate of said additional NPN bipolar transistor corresponding to an each said one delay one-shot, and said trigger one-shot;

an additional optical coupler having a corresponding additional light-emitting diode and a corresponding additional phototriac;

means for connecting a cathode of said corresponding additional light-emitting diode and said collector of said additional NPN bipolar transistor;

an additional resistor;

means for connecting said additional resistor between a point of positive circuit bias and an anode of said corresponding additional light-emitting diode;

an additional triac corresponding to said corresponding additional phototriac;

means for connecting said corresponding additional phototriac and said additional triac; and means for connecting said additional triac to a ballast of said fluorescent lamp and the ac line voltage;

said at least one delay one-shot connected in series to a trigger one-shot, said additional NPN bipolar transistor corresponding to each said delay one-shot, said corresponding additional light-emitting diode and said corresponding additional phototriac, said additional resistor and additional triac having parameters selected so that said input dc voltage signal causes said additional triac to energize and apply voltage across terminals of the ballast of the additional fluroescent lamp for a shortened duration of time during a half-cycle of ac voltage application which is, and wherein said shortened duration of time during a half-cycle of ac voltage application decreases proportionally with an increase in voltage of said input dc voltage signal.

7. The invention of claim 6, further comprising:

a third operational amplifier corresponding to said at least one delay one-shot, having an inverting terminal, a noninverting terminal and an output terminal;

means for connecting said positive terminal of said polarized capacitor and said inverting terminal of said third operational amplifier;

a PNP bipolar transistor corresponding to said third operational amplifier, having a gate, a collector and an emitter;

means for connecting said output terminal of said third operational amplifier and said gate of said PNP bipolar transistor;

means for connecting said collector of said PNP bipolar transistor and a point of ground circuit bias;

a fourth resistor;

means for connecting said fourth resistor between said noninverting terminal of said third operational amplifier and said emitter of said PNP bipolar transistor;

a potentiometer having a wiper and two terminals;

means for connecting a terminal of said two terminals of said potentiometer to a point of positive circuit bias;

means for connecting said wiper of said potentiometer and said noninverting terminal of said third operational amplifier;

means for connecting an other terminal of said two terminals of said potentiometer and a point of ground circuit bias;

a diode;

means for connecting an anode of said diode and said output terminal of said second operational amplifier; and means for connecting a cathode of said diode and said output terminal of said third operational amplifier;

said third operational amplifier, said PNP bipolar transistor, said fourth resistor, and said diode having parameters selected so that said additional NPN bipolar transistor is not energized and said PNP bipolar transistor is energized when a voltage applied to said inverting terminal of said second operational amplifier is greater than a voltage selected by adjustment of said potentiometer and said additional NPN bipolar transistor does not conduct again until the voltage applied to said inverting terminal of said third operational amplifier decreases to slightly below said voltage selected by adjustment of said potentiometer.

8. The invention of claim 4, further comprising means for maintaining an optimum voltage across a heater filament of the fluorescent lamp.

9. The invention of claim 8, said means for maintaining an optimum voltage across a heater filament of the fluorescent lamp comprising means for maintaining a potential of about 4 v across the heater filament.

10. The invention of claim 9, said means for maintaining a potential of about 4 v across the heater filament comprising a transformer having a primary winding directly connected to a voltage source and having at least one secondary winding connected to a heater filament and applying a potential of about 4 v across the filament.

11. The invention of claim 9, said means for maintaining a potential of about 4 v across the heater filament comprising:

a diode for voltage regulation having an anode and a cathode;

a capacitor;

means for connecting said anode of said diode for voltage regulation to a high-voltage winding of the ballast of the fluorescent lamp; and means for connecting said capacitor between a pair of leads which connect the ballast to a filament of the fluorescent lamp and wherein an end of said capacitor is connected to said cathode of said diode for voltage regulation;

said diode for voltage regulation and said capacitor having parameters selected so that said capacitor maintains a potential of about 4 vdc across the filament of the fluorescent lamp.

* * * * *